US011608734B2

(12) United States Patent
Ayub et al.

(10) Patent No.: US 11,608,734 B2
(45) Date of Patent: Mar. 21, 2023

(54) SYSTEMS AND METHODS FOR CREATING HYDROCARBON WELLS

(71) Applicant: Saudi Arabian Oil Company, Dhahran (SA)

(72) Inventors: Jibran Ayub, Dhahran Hills (SA); Nayif Jama, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 354 days.

(21) Appl. No.: 16/871,569

(22) Filed: May 11, 2020

(65) Prior Publication Data

US 2021/0348497 A1 Nov. 11, 2021

(51) Int. Cl.
*E21B 47/003* (2012.01)
*E21B 47/022* (2012.01)
*E21B 43/30* (2006.01)

(52) U.S. Cl.
CPC ..... *E21B 47/003* (2020.05); *E21B 43/305* (2013.01); *E21B 47/022* (2013.01)

(58) Field of Classification Search
CPC ..... E21B 47/003; E21B 43/305; E21B 47/022
See application file for complete search history.

(56) References Cited

U.S. PATENT DOCUMENTS 6,549,879 B1 4/2003 Cullick et al.
6,619,396 B1 9/2003 Kimoto et al.
8,099,266 B2 1/2012 Burge et al.
9,470,086 B2 10/2016 Khalid et al.
9,574,433 B2 2/2017 Benneii

FOREIGN PATENT DOCUMENTS

CN 105952432 A 9/2016
CN 106869884 B 6/2017
CN 108805317 A 11/2018
(Continued)

OTHER PUBLICATIONS

Khalid Aziz, "Effects of pressure drop in Horizontal wells and optimum well length" SPE Journal, vol. 4, No. 3 pp. 215-223 (Year: 1999).*

(Continued)

*Primary Examiner* — Natalie Huls
*Assistant Examiner* — Sharad Timilsina
(74) *Attorney, Agent, or Firm* — Bracewell LLP; Constance G. Rhebergen; Brian H. Tompkins

(57) ABSTRACT

Provided are embodiments that include identifying candidate well parameters for a hydrocarbon well that include a location, a well production rate and candidate horizontal wellbore lateral lengths for the well, conducting simulations of hydrocarbon wells located at the location and having lateral lengths corresponding to the candidate horizontal wellbore lateral lengths and operating at the well production rate to determine a gas breakthrough productivity indexes (GBPIs) for the simulated wells, determining (based on the GBPIs) a relationship of GBPI to horizontal wellbore lateral length, determining (based on the relationship) an optimized horizontal wellbore lateral length for the production rate, and developing the well based on the optimized horizontal wellbore lateral length.

18 Claims, 7 Drawing Sheets

(56) References Cited

FOREIGN PATENT DOCUMENTS

| | | | |
|---|---|---|---|
| CN | 109236255 | A | 1/2019 |
| RU | 2617820 | C2 * | 4/2017 |

OTHER PUBLICATIONS

Cho, H. et al.; "Optimization of Well Length for Horizontal Drilling" Paper 2000-27, Canadian International Petroleum Conference, Calgary, AB, Jun. 4-8, 2000; pp. 1-16.
Cho, Hyun; "Integrated Optimization on Long Horizongal Well Length" SPE 68599, SPE Hydrocarbon Economics & Evaluation Symposium, Dallas, TX, Apr. 2-3, 2001; pp. 1-14.
Orodu, O.D. et al.; "Realistic Optimization of Well Length for Horizontal Drilling" Brazillian Journal of Petroleum and Gas, v. 6 n. 2 (2012); pp. 053-065.
Syed, Adnan; "Horizontal well length optimization considering wellbore hydraulics" NTNU—Trondheim, Norwegian University of Science and Technology, submitted Jun. 2014; pp. 1-110.
International Search Report and Written Opinion for International Application No. PCT/US2021/031807 (SA51456), report dated Aug. 27, 2021; pp. 1-15.
Penmatcha, V.R. et al.; "Effects of Pressure Drop in Horizontal Wells and Optimum Well Length" SPE 57193, Society of Petroleum Engineers, SPE Journal 4 (3), Sep. 1999; pp. 215-223.

* cited by examiner

SYSTEMS AND METHODS FOR CREATING HYDROCARBON WELLS

FIELD

Embodiments relate generally to developing hydrocarbon reservoirs and, more particularly, to creating hydrocarbon wells in hydrocarbon reservoirs.

BACKGROUND

A hydrocarbon reservoir is a pool of hydrocarbons (e.g., oil or gas) trapped in a subsurface rock formation. Hydrocarbon wells are often drilled into hydrocarbon reservoirs to extract (or "produce") the trapped hydrocarbons. In many instances, hydrocarbon wells are drilled and operated in a manner to optimize production of hydrocarbons. For example, a reservoir is typically assessed to identify characteristics of the reservoir (e.g., locations and amount of hydrocarbons and other substances trapped in the reservoir and properties of the rock forming the reservoir), the locations and trajectories (or "paths") of wells to be drilled into the reservoir are determined based on the characteristics, the wells are drilled into the reservoir in accordance with the locations and trajectories, and the wells are operated to facilitate efficient extraction of the hydrocarbons from the reservoir.

A well traditionally includes a generally wellbore that extends downward into the earth. The term "vertical well" is often used to describe a well having a wellbore that extends downward, in a generally vertical direction. The term "horizontal well" is often used to describe a well having a wellbore section that extends in a generally horizontal direction. A horizontal well often includes a generally vertical or deviated wellbore having an upper/vertical wellbore portion that extends downward into the earth in a direction that is generally perpendicular to the earth's surface, and a lower/horizontal wellbore portion that extends in a generally horizontal direction through the earth, often following a profile of a reservoir. The trajectory of the wellbore of a horizontal well, including a length of the lower-horizontal wellbore portion of the horizontal well, is typically designed to increase the amount of hydrocarbons that are extracted from the reservoir by way of the well.

SUMMARY

Although there are numerous existing techniques for identifying locations and trajectories for wells to be drilled into a hydrocarbon reservoir, they often suffer from shortcomings and do not facilitate optimizing the extraction of hydrocarbons from the reservoir. For example, in view of the costs associated with drilling each well, many reservoir operators elect to drill relative long wells. This approach is based on an expectation that a relatively long wellbore will provide increased production over the life of the well, and that the increased production will outweigh the marginal costs for drilling a longer wellbore. Unfortunately, such an approach does not necessarily optimize production.

Although longer wells can exhibit a greater amount of overall production, there can be significant variations in the amount of hydrocarbons produced from different portions of the well. During production operations, hydrocarbons in a "proximal" portion of the reservoir (e.g., hydrocarbons trapped near the heel of the wellbore) may migrate through the reservoir and into the wellbore at a higher rate than hydrocarbons in a distal portion of the reservoir (e.g., hydrocarbons trapped near the "toe" of the wellbore). As a result, a "heel" of a horizontal wellbore (e.g., a proximal end of a horizontal portion of the wellbore that is near the vertical portion of the wellbore) may be more effective at extracting hydrocarbons than a "toe" of the wellbore (e.g., a distal end of the horizontal portion of the wellbore). With a relatively long horizontal well, it is often the case that a relatively large portion of the overall well's production comes from production flow into the "heel" of the wellbore and a relatively small portion of the well's overall production comes from production flow into the "toe" of the wellbore.

The phenomenon of variations in effective production across the length of a wellbore is not necessarily due to a lack of producible hydrocarbons near the toe of the wellbore, but is typically attributable to differences in pressure across the length of the wellbore and how reservoir fluids move in response to production operations. As hydrocarbons move through a reservoir and into a wellbore, they often are followed (or "pushed") by other substances (e.g., injected gas or water) that eventually enter (or "break into") the wellbore as the hydrocarbons leading the way are extracted. The "breakthrough" of substances into a well is typically undesirable because it can significantly inhibit the ability of the well to efficiently produce hydrocarbons. In comparison to a "thick" hydrocarbon such as oil, injected gas and water typically moves relatively freely through the reservoir rock and into the wellbore. As a result, following a breakthrough, injection gas or water may move relatively easily into the wellbore at the location of the breakthrough, which results in undesirable gas or water production in place of desirable oil production. Unfortunately, a breakthrough in one section of a wellbore can significantly reduce the ability to produce hydrocarbons from other portions of the wellbore, including those where breakthrough has not yet occurred. In some instances, a breakthrough can require special operations to be undertaken, and a breakthrough can even make it uneconomical to continue to operate the well. Accordingly, an early breakthrough can significantly shorten the productive life of a well. In the case of a long horizontal well, given the relatively large amount of production extracted from the heel of the wellbore, it is common to experience a breakthrough in the heel of the wellbore relatively early in the life of the well, in advance of a threat of breakthrough in the toe of the wellbore. This can make it difficult, or even impractical, to fully extract hydrocarbons from a portion of the reservoir surrounding the toe of the wellbore. As a result, a relatively long horizontal well may efficiently extract (or "sweep") hydrocarbons from a portion of the reservoir surrounding the heel of the wellbore, but may leave an undesirably large amount of "un-swept" hydrocarbons in the portion of the reservoir surrounding the toe of the wellbore.

In certain instances, drilling one or more "short" horizontal wells in place of a single "long" horizontal well can be beneficial. Multiple short wells of optimized length may provide a more uniform sweep of a reservoir in comparison to the sweep of a single long well. For example, multiple short wells may provide an increased area of recovery that does not include large pockets of un-swept oil that would be left behind by a single long well. Unfortunately, identifying suitable locations and lengths for horizontal wells can be challenging. This is especially true given that a long well tends to exhibit a relatively high productivity index (PI) based on the well's ability to produce large volumes of oil, regardless of amount of un-swept oil left behind.

In some embodiments, provided is a technique for determining and employing an optimized horizontal well lateral length. In some embodiments, determining an optimized lateral length for a horizontal hydrocarbon well includes the following: (a) identifying candidate well parameters, including: (i) a well location for the hydrocarbon well, (ii) one or more candidate well production rates for the hydrocarbon well, and (iii) candidate horizontal wellbore lateral lengths for the hydrocarbon well; (b) conducting, for each combination of the one or more candidate well production rates and the candidate horizontal wellbore lateral lengths, a well simulation of a hydrocarbon well located at the well location, having a horizontal wellbore lateral length that corresponds to the candidate horizontal wellbore length, and operating at production rate corresponding to the candidate well production rate, to determine (i) a gas breakthrough time that corresponds to an estimated time of the gas breakthrough into the wellbore of the simulated hydrocarbon well, and (ii) a gas breakthrough productivity index (GBPI) for the hydrocarbon well that corresponds to a PI of the simulated hydrocarbon well at the gas breakthrough time; (c) for each of the one or more candidate well production rates: (i) determining, based on the gas breakthrough productivity indexes (GBPIs) for the combinations of the one or more candidate well production rates and the candidate horizontal wellbore lateral lengths, a relationship of GBPI to horizontal wellbore length for the candidate well production rate; and (ii) determining, based on the relationship of GBPI to horizontal wellbore length, an optimized horizontal wellbore lateral length that corresponds to a lateral length at which a ratio of a change of the GBPI for the hydrocarbon well versus a corresponding change in the length of the wellbore for the candidate well production rate is below a GBPI-length threshold. A horizontal well may be drilled into the reservoir at the well location with a horizontal wellbore portions having a lateral length that corresponds to an optimized horizontal wellbore lateral length determined, and may be operated in accordance with the candidate well production rate that corresponds to the optimized horizontal wellbore lateral length.

Provided in some embodiments is a method of developing a hydrocarbon well, the method including: identifying candidate well parameters for a hydrocarbon well, the candidate well parameters including: a location for the hydrocarbon well; a well production rate for the hydrocarbon well; and candidate horizontal wellbore lateral lengths for a horizontal portion of a wellbore of the hydrocarbon well; conducting, for each candidate horizontal wellbore lateral length of the candidate horizontal wellbore lateral lengths, a simulation of a hydrocarbon well located at the location and having a wellbore having a horizontal wellbore portion of a lateral length that corresponds to the candidate horizontal wellbore lateral length and operating at the well production rate, the simulation including: determining a gas breakthrough into the wellbore of the simulated hydrocarbon well; determining a gas breakthrough time that corresponds to the time of the gas breakthrough into the wellbore of the simulated hydrocarbon well; and determining a gas breakthrough productivity index (GBPI) for the simulated hydrocarbon well that corresponds to a productivity index (PI) of the simulated hydrocarbon well at the gas breakthrough time; determining, based on the gas breakthrough productivity indexes (GBPIs) for the candidate horizontal wellbore lateral lengths and the well production rate, a relationship of GBPI to horizontal wellbore lateral length; determining, based on the relationship of GBPI to horizontal wellbore lateral length, an optimized horizontal wellbore lateral length for the production rate that corresponds to a horizontal wellbore lateral length at which a ratio of a change of the GBPI for the simulated hydrocarbon well to a corresponding change in the horizontal wellbore lateral length is below a GBPI-length threshold; and drilling, at the location, the hydrocarbon well having a wellbore having a horizontal wellbore portion having a lateral length that corresponds to the optimized horizontal wellbore lateral length.

In some embodiments, the candidate well parameters includes a second well production rate for the hydrocarbon well, and where the method further includes: conducting, for each candidate horizontal wellbore lateral length of the candidate horizontal wellbore lateral lengths, a simulation of a hydrocarbon well located at the location and having a wellbore having a horizontal wellbore portion of a lateral length that corresponds to the candidate horizontal wellbore lateral length and operating at the second well production rate, the simulation including: determining a gas breakthrough into the wellbore of the simulated hydrocarbon well; determining a gas breakthrough time that corresponds to the time of the gas breakthrough into the wellbore of the simulated hydrocarbon well; and determining a GBPI for the simulated hydrocarbon well that corresponds to a PI of the simulated hydrocarbon well at the gas breakthrough time; determining, based on the gas breakthrough productivity indexes (GBPIs) for the candidate horizontal wellbore lateral lengths and the second production rate, a second relationship of GBPI to horizontal wellbore lateral length; and determining, based on the second relationship of GBPI to horizontal wellbore lateral length, an optimized horizontal wellbore lateral length for the second production rate that corresponds to a horizontal wellbore lateral length at which a ratio of a change of the GBPI for the hydrocarbon well to a corresponding change in the horizontal wellbore lateral length is below the GBPI-length threshold. In certain embodiments, determining the optimized horizontal wellbore lateral length for the production rate that corresponds to a horizontal wellbore lateral length at which a ratio of a change of the GBPI for the hydrocarbon well to a corresponding change in the horizontal wellbore lateral length is below the GBPI-length threshold includes: determining a curve for the relationship of GBPI to horizontal wellbore lateral length; and determining a horizontal wellbore lateral length that corresponds to a point at which a slope of the curve falls below the GBPI-length threshold. In some embodiments, the horizontal wellbore lateral length at which a ratio of a change of the GBPI for the hydrocarbon well to a corresponding change in the horizontal wellbore lateral length is below the GBPI-length threshold corresponds to a lateral length above which the PI for the hydrocarbon well exhibits a plateau. In certain embodiments, the method further includes operating the hydrocarbon well at the production rate. In some embodiments, the method further includes: identifying second candidate well parameters for a second hydrocarbon well, the second candidate well parameters including: a second location for the second hydrocarbon well; a second well production rate for the second hydrocarbon well; and second candidate horizontal wellbore lateral lengths for a horizontal portion of a wellbore of the second hydrocarbon well; conducting, for each candidate horizontal wellbore lateral length of the second candidate horizontal wellbore lateral lengths, a simulation of a hydrocarbon well located at the second location and having a wellbore having a horizontal wellbore portion of a lateral length that corresponds to the candidate horizontal wellbore lateral length and operating at the second well production rate, the simulation including: determining a gas breakthrough into the wellbore of the simulated hydrocarbon well; determining a gas breakthrough time that corresponds to the time of the gas breakthrough into the wellbore of the simulated hydrocarbon well; and determining a GBPI for the simulated hydrocarbon well that corresponds to a productivity index (PI) of the simulated hydrocarbon well at the gas breakthrough time; determining, based on the GBPIs for the second candidate horizontal wellbore lateral lengths and the second well production rate, a relationship of GBPI to horizontal wellbore lateral length; determining, based on the relationship of GBPI to horizontal wellbore lateral length, a second optimized horizontal wellbore lateral length for the second production rate that corresponds to a horizontal wellbore lateral length at which a ratio of a change of the GBPI for the simulated hydrocarbon well to a corresponding change in the horizontal wellbore lateral length is below a GBPI-length threshold; and drilling, at the second location, the second hydrocarbon well having a horizontal wellbore lateral length that corresponds to the second optimized horizontal wellbore lateral length.

Provided in some embodiments is a system for developing a hydrocarbon well that includes: a processor; and non-transitory computer readable storage medium including program instructions stored thereon that are executable by the processor to perform the following operations: identifying candidate well parameters for a hydrocarbon well, the candidate well parameters including: a location for the hydrocarbon well; a well production rate for the hydrocarbon well; and candidate horizontal wellbore lateral lengths for a horizontal portion of a wellbore of the hydrocarbon well; conducting, for each candidate horizontal wellbore lateral length of the candidate horizontal wellbore lateral lengths, a simulation of a hydrocarbon well located at the location and having a wellbore having a horizontal wellbore portion of a lateral length that corresponds to the candidate horizontal wellbore lateral length and operating at the well production rate, the simulation including: determining a gas breakthrough into the wellbore of the simulated hydrocarbon well; determining a gas breakthrough time that corresponds to the time of the gas breakthrough into the wellbore of the simulated hydrocarbon well; and determining a gas breakthrough productivity index (GBPI) for the simulated hydrocarbon well that corresponds to a productivity index (PI) of the simulated hydrocarbon well at the gas breakthrough time; determining, based on the gas breakthrough productivity indexes (GBPIs) for the candidate horizontal wellbore lateral lengths and the well production rate, a relationship of GBPI to horizontal wellbore lateral length; and determining, based on the relationship of GBPI to horizontal wellbore lateral length, an optimized horizontal wellbore lateral length for the production rate that corresponds to a horizontal wellbore lateral length at which a ratio of a change of the GBPI for the simulated hydrocarbon well to a corresponding change in the horizontal wellbore lateral length is below a GBPI-length threshold; and drilling, at the location, the hydrocarbon well having a wellbore having a horizontal wellbore portion having a lateral length that corresponds to the optimized horizontal wellbore lateral length.

In some embodiments, the candidate well parameters include a second well production rate for the hydrocarbon well, and the operations further include: conducting, for each candidate horizontal wellbore lateral length of the candidate horizontal wellbore lateral lengths, a simulation of a hydrocarbon well located at the location and having a wellbore having a horizontal wellbore portion of a lateral length that corresponds to the candidate horizontal wellbore lateral length and operating at the second well production rate, the simulation including: determining a gas breakthrough into the wellbore of the simulated hydrocarbon well; determining a gas breakthrough time that corresponds to the time of the gas breakthrough into the wellbore of the simulated hydrocarbon well; and determining a GBPI for the simulated hydrocarbon well that corresponds to a PI of the simulated hydrocarbon well at the gas breakthrough time; determining, based on the gas breakthrough productivity indexes (GBPIs) for the candidate horizontal wellbore lateral lengths and the second production rate, a second relationship of GBPI to horizontal wellbore lateral length; and determining, based on the second relationship of GBPI to horizontal wellbore lateral length, an optimized horizontal wellbore lateral length for the second production rate that corresponds to a horizontal wellbore lateral length at which a ratio of a change of the GBPI for the hydrocarbon well to a corresponding change in the horizontal wellbore lateral length is below the GBPI-length threshold. In certain embodiments, determining the optimized horizontal wellbore lateral length for the production rate that corresponds to a horizontal wellbore lateral length at which a ratio of a change of the GBPI for the hydrocarbon well to a corresponding change in the horizontal wellbore lateral length is below the GBPI-length threshold includes: determining a curve for the relationship of GBPI to horizontal wellbore lateral length; and determining a horizontal wellbore lateral length that corresponds to a point at which a slope of the curve falls below the GBPI-length threshold. In some embodiments, the horizontal wellbore lateral length at which a ratio of a change of the GBPI for the hydrocarbon well to a corresponding change in the horizontal wellbore lateral length is below the GBPI-length threshold corresponds to a lateral length above which the PI for the hydrocarbon well exhibits a plateau. In some embodiments, the operations further include operating the hydrocarbon well at the production rate. In certain embodiments, the operations further include: identifying second candidate well parameters for a second hydrocarbon well, the second candidate well parameters including: a second location for the second hydrocarbon well; a second well production rate for the second hydrocarbon well; and second candidate horizontal wellbore lateral lengths for a horizontal portion of a wellbore of the second hydrocarbon well; conducting, for each candidate horizontal wellbore lateral length of the second candidate horizontal wellbore lateral lengths, a simulation of a hydrocarbon well located at the second location and having a wellbore having a horizontal wellbore portion of a lateral length that corresponds to the candidate horizontal wellbore lateral length and operating at the second well production rate, the simulation including: determining a gas breakthrough into the wellbore of the simulated hydrocarbon well; determining a gas breakthrough time that corresponds to the time of the gas breakthrough into the wellbore of the simulated hydrocarbon well; and determining a GBPI for the simulated hydrocarbon well that corresponds to a productivity index (PI) of the simulated hydrocarbon well at the gas breakthrough time; determining, based on the GBPIs for the second candidate horizontal wellbore lateral lengths and the second well production rate, a relationship of GBPI to horizontal wellbore lateral length; determining, based on the relationship of GBPI to horizontal wellbore lateral length, a second optimized horizontal wellbore lateral length for the second production rate that corresponds to a horizontal wellbore lateral length at which a ratio of a change of the GBPI for the simulated hydrocarbon well to a corresponding change in the horizontal wellbore lateral length is below a GBPI-length threshold; and drilling, at the second location, the second hydrocarbon well having a horizontal wellbore lateral length that corresponds to the second optimized horizontal wellbore lateral length.

Provided in some embodiments is non-transitory computer readable storage medium including program instructions stored thereon that are executable by a processor to perform the following operations for developing a hydrocarbon well: identifying candidate well parameters for a hydrocarbon well, the candidate well parameters including: a location for the hydrocarbon well; a well production rate for the hydrocarbon well; and candidate horizontal wellbore lateral lengths for a horizontal portion of a wellbore of the hydrocarbon well; conducting, for each candidate horizontal wellbore lateral length of the candidate horizontal wellbore lateral lengths, a simulation of a hydrocarbon well located at the location and having a wellbore having a horizontal wellbore portion of a lateral length that corresponds to the candidate horizontal wellbore lateral length and operating at the well production rate, the simulation including: determining a gas breakthrough into the wellbore of the simulated hydrocarbon well; determining a gas breakthrough time that corresponds to the time of the gas breakthrough into the wellbore of the simulated hydrocarbon well; and determining a gas breakthrough productivity index (GBPI) for the simulated hydrocarbon well that corresponds to a productivity index (PI) of the simulated hydrocarbon well at the gas breakthrough time; determining, based on the gas breakthrough productivity indexes (GBPIs) for the candidate horizontal wellbore lateral lengths and the well production rate, a relationship of GBPI to horizontal wellbore lateral length; and determining, based on the relationship of GBPI to horizontal wellbore lateral length, an optimized horizontal wellbore lateral length for the production rate that corresponds to a horizontal wellbore lateral length at which a ratio of a change of the GBPI for the simulated hydrocarbon well to a corresponding change in the horizontal wellbore lateral length is below a GBPI-length threshold; and drilling, at the location, the hydrocarbon well having a wellbore having a horizontal wellbore portion having a lateral length that corresponds to the optimized horizontal wellbore lateral length.

In some embodiments, the candidate well parameters include a second well production rate for the hydrocarbon well, and the operations further include: conducting, for each candidate horizontal wellbore lateral length of the candidate horizontal wellbore lateral lengths, a simulation of a hydrocarbon well located at the location and having a wellbore having a horizontal wellbore portion of a lateral length that corresponds to the candidate horizontal wellbore lateral length and operating at the second well production rate, the simulation including: determining a gas breakthrough into the wellbore of the simulated hydrocarbon well; determining a gas breakthrough time that corresponds to the time of the gas breakthrough into the wellbore of the simulated hydrocarbon well; and determining a GBPI for the simulated hydrocarbon well that corresponds to a PI of the simulated hydrocarbon well at the gas breakthrough time; determining, based on the gas breakthrough productivity indexes (GBPIs) for the candidate horizontal wellbore lateral lengths and the second production rate, a second relationship of GBPI to horizontal wellbore lateral length; and determining, based on the second relationship of GBPI to horizontal wellbore lateral length, an optimized horizontal wellbore lateral length for the second production rate that corresponds to a horizontal wellbore lateral length at which a ratio of a change of the GBPI for the hydrocarbon well to a corresponding change in the horizontal wellbore lateral length is below the GBPI-length threshold.

In some embodiments, determining the optimized horizontal wellbore lateral length for the production rate that corresponds to a horizontal wellbore lateral length at which a ratio of a change of the GBPI for the hydrocarbon well to a corresponding change in the horizontal wellbore lateral length is below the GBPI-length threshold includes: determining a curve for the relationship of GBPI to horizontal wellbore lateral length; and determining a horizontal wellbore lateral length that corresponds to a point at which a slope of the curve falls below the GBPI-length threshold. In certain embodiments, the horizontal wellbore lateral length at which a ratio of a change of the GBPI for the hydrocarbon well to a corresponding change in the horizontal wellbore lateral length is below the GBPI-length threshold corresponds to a lateral length above which the PI for the hydrocarbon well exhibits a plateau. In some embodiments, the operations further including operating the hydrocarbon well at the production rate. In certain embodiments, the operations further include: identifying second candidate well parameters for a second hydrocarbon well, the second candidate well parameters including: a second location for the second hydrocarbon well; a second well production rate for the second hydrocarbon well; and second candidate horizontal wellbore lateral lengths for a horizontal portion of a wellbore of the second hydrocarbon well; conducting, for each candidate horizontal wellbore lateral length of the second candidate horizontal wellbore lateral lengths, a simulation of a hydrocarbon well located at the second location and having a wellbore having a horizontal wellbore portion of a lateral length that corresponds to the candidate horizontal wellbore lateral length and operating at the second well production rate, the simulation including: determining a gas breakthrough into the wellbore of the simulated hydrocarbon well; determining a gas breakthrough time that corresponds to the time of the gas breakthrough into the wellbore of the simulated hydrocarbon well; and determining a GBPI for the simulated hydrocarbon well that corresponds to a productivity index (PI) of the simulated hydrocarbon well at the gas breakthrough time; determining, based on the GBPIs for the second candidate horizontal wellbore lateral lengths and the second well production rate, a relationship of GBPI to horizontal wellbore lateral length; determining, based on the relationship of GBPI to horizontal wellbore lateral length, a second optimized horizontal wellbore lateral length for the second production rate that corresponds to a horizontal wellbore lateral length at which a ratio of a change of the GBPI for the simulated hydrocarbon well to a corresponding change in the horizontal wellbore lateral length is below a GBPI-length threshold; and drilling, at the second location, the second hydrocarbon well having a horizontal wellbore lateral length that corresponds to the second optimized horizontal wellbore lateral length.

Figure 1:
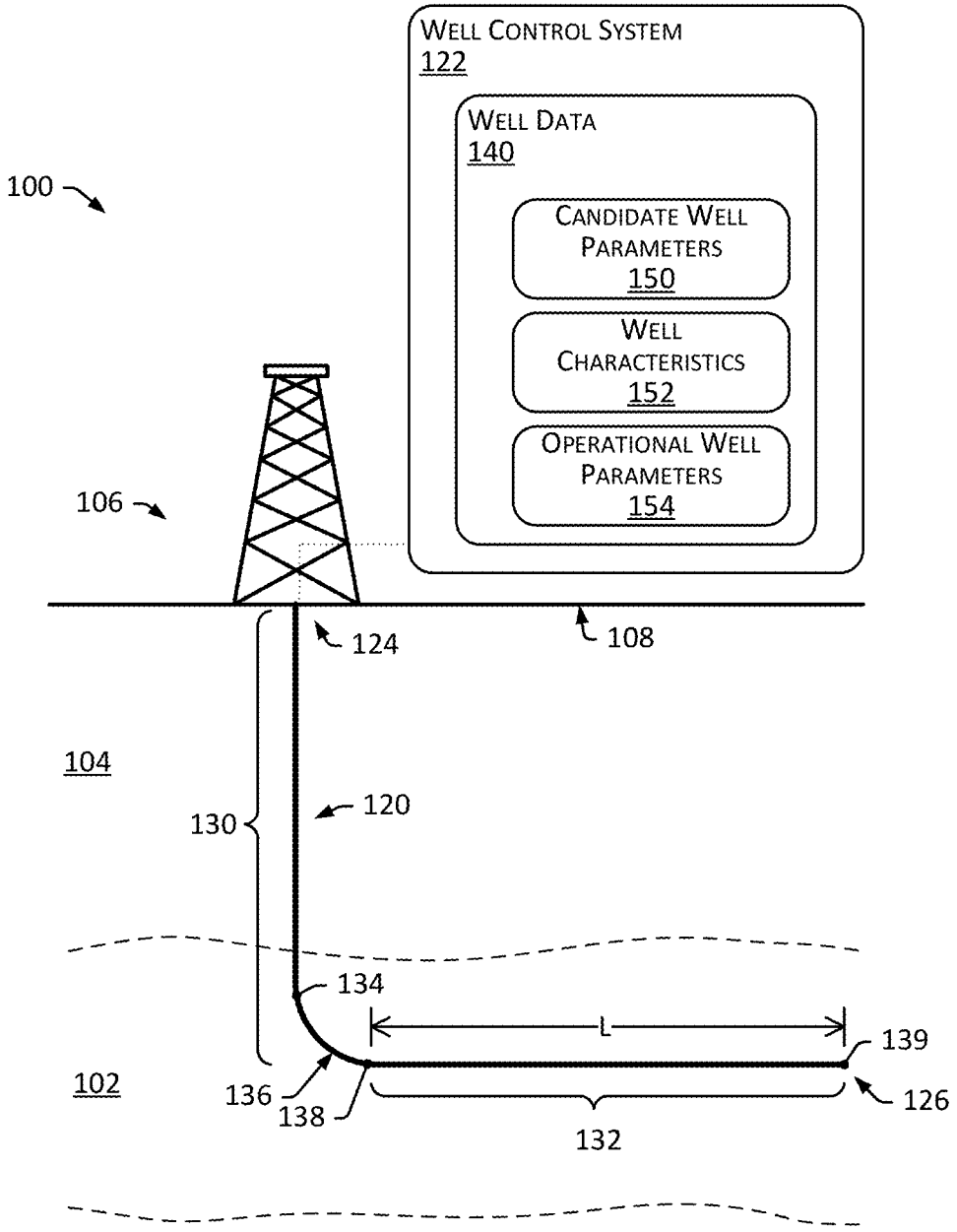
FIG. 1 is diagram that illustrates a well environment in accordance with one or more embodiments.

While this disclosure is susceptible to various modifications and alternative forms, specific embodiments are shown by way of example in the drawings and will be described in detail. The drawings may not be to scale. It should be understood that the drawings and the detailed descriptions are not intended to limit the disclosure to the particular form disclosed, but are intended to disclose modifications, equivalents, and alternatives falling within the scope of the present disclosure as defined by the claims.

DETAILED DESCRIPTION

Described are embodiments of determining and employing an optimized horizontal well lateral length. In some embodiments, determining an optimized lateral length for a horizontal hydrocarbon well includes the following: (a) identifying candidate well parameters, including: (i) a well location for the hydrocarbon well, (ii) one or more candidate well production rates for the hydrocarbon well, and (iii) candidate horizontal wellbore lateral lengths for the hydrocarbon well; (b) conducting, for each combination of the one or more candidate well production rates and the candidate horizontal wellbore lateral lengths, a well simulation of a hydrocarbon well located at the well location, having a horizontal wellbore lateral length that corresponds to the candidate horizontal wellbore length, and operating at production rate corresponding to the candidate well production rate, to determine (i) a gas breakthrough time that corresponds to an estimated time of the gas breakthrough into the wellbore of the simulated hydrocarbon well, and (ii) a gas breakthrough productivity index (GBPI) for the hydrocarbon well that corresponds to a productivity index (PI) of the simulated hydrocarbon well at the gas breakthrough time; (c) for each of the one or more candidate well production rates: (i) determining, based on the gas breakthrough productivity indexes (GBPIs) for the combinations of the one or more candidate well production rates and the candidate horizontal wellbore lateral lengths, a relationship of GBPI to horizontal wellbore length for the candidate well production rate; and (ii) determining, based on the relationship of GBPI to horizontal wellbore length, an optimized horizontal wellbore lateral length that corresponds to a lateral length at which a ratio of a change of the GBPI for the hydrocarbon well versus a corresponding change in the length of the wellbore for the candidate well production rate is below a GBPI-length threshold. A horizontal well may be drilled into the reservoir at the well location with a horizontal wellbore portions having a lateral length that corresponds to an optimized horizontal wellbore lateral length determined, and may be operated in accordance with the candidate well production rate that corresponds to the optimized horizontal wellbore lateral length.

FIG. 1 is a diagram that illustrates a well environment 100 in accordance with one or more embodiments. In the illustrated embodiment, the well environment 100 includes a reservoir ("reservoir") 102 located in a subsurface formation ("formation") 104, and a well system ("well") 106.

The formation 104 may include a porous or fractured rock formation that resides beneath the Earth's surface 108. The reservoir 102 may be a hydrocarbon reservoir defined by a portion of the formation 104 that contains (or that is determined to contain) a subsurface pool of hydrocarbons (e.g., oil and gas), and the well 106 may be a hydrocarbon well (e.g., an oil and gas well) that is operable to extract the hydrocarbons from the reservoir 102. The formation 104 and the reservoir 102 may each include different layers of rock having varying characteristics, such as varying degrees of lithology, permeability, porosity and fluid saturation. In the case of the well 106 being operated as a hydrocarbon production well, the well 106 may facilitate the extraction of hydrocarbons (or "production") from the reservoir 102. In the case of the well 106 being operated as an injection well, the well 106 may facilitate the injection of substances (e.g., gas or water) into the formation 104. In the case of the well 106 being operated as a monitoring well, the well 106 may facilitate the monitoring of various characteristics of the formation 104, such as reservoir saturation or reservoir pressure.

The well 106 may include a wellbore 120 and a well control system ("control system") 122. The control system 122 may control various operations of the well 106, such as well drilling operations, well completion operations, well production operations, or well and formation testing and monitoring operations. In some embodiments, the control system 122 includes a computer system that is the same as or similar to that of computer system 1000 described with regard to at least FIG. 7.

The wellbore 120 may include a bored hole (or "borehole") that extends from the surface 108 into a target zone of the formation 104, such as the reservoir 102. An upper end 124 of the wellbore 120 located at or near the surface 108 may be referred to as the "up-hole" end of the wellbore 120. A lower end 126 of the wellbore 120 that terminates in the formation 104 may be referred to as a "down-hole" end of the wellbore 120. The wellbore 120 may be created, for example, by a drill bit boring through the formation 104. The wellbore 120 may provide for the circulation of drilling fluids during drilling operations, may direct the flow of hydrocarbons (e.g., oil and gas) from the reservoir 102 to the surface 108 during production operations, may direct the injection of substances (e.g., water or gas) into the reservoir 102 during injection operations, or may provide a path for the communication and placement of sensing devices in the reservoir 102 for monitoring operations.

The wellbore 120 may be a horizontal wellbore defined a vertical wellbore portion 130 and a horizontal wellbore portion 132. The vertical wellbore portion 130 may extend downward from the surface 108 in a generally vertical trajectory, and the horizontal wellbore portion 132 may extend from a down-hole end of the vertical wellbore portion 130 in a generally horizontal trajectory. The vertical wellbore portion 130 may, for example, include a vertical segment of the wellbore 120 that extends downward from the surface 108 in a trajectory having a slope (or "gradient") of about +/−15° from vertical). The vertical wellbore portion 130 may deviate from its generally vertical orientation at a kick-off-point (KOP) 134 and extend into a bend (or "curve") 136 that terminates at a start (or "heel" or "lateral heel") 138 of the horizontal wellbore portion 132. The horizontal wellbore portion 132 may include, for example, a segment of the wellbore 120 that extends in a generally horizontal orientation from the heel 138 to a down-hole end (or "toe" or "lateral toe") 139 of the wellbore 120, in generally horizontal trajectory (e.g., a trajectory having a slope (or "gradient") of about +/−15° from horizontal). The heel 138 may be defined as a point at which the wellbore 120 achieves a target orientation within the reservoir 102. The toe 139 may be defined by a down-hole end 126 of the wellbore 120. A length of the horizontal wellbore portion 132 (or "lateral length") L may be defined by a distance between the heel 138 and the toe 139 of the wellbore 120. As described here, the lateral length L of the well 106 may be determined, for example, by way of assessment of multiple "candidate" lateral lengths as associated GBPIs.

In some embodiments, the control system 122 stores, or otherwise has access to, well data 140. The well data 140 may include data that is indicative of various characteristics of the well 106, such as candidate well parameters 150, well characteristics 152, and operational well parameters 152. In some embodiment, the candidate well parameters 150 include well parameters for consideration in designing and operating the well 106, such as candidate well operating flowrates and pressures, and candidate lateral lengths for the horizontal wellbore portion 132 of the well 106. For example, the candidate well parameters 150 may include candidate well operating flowrates (q) of 6000, 8000, 10000, and 12000 stock tank barrels per day (STB/day) for the well 106, and candidate lateral lengths (L) of 500, 1000, 1500, and 2000 meters (m) for the well 106. In some embodiments, the well characteristics 152 include various properties of the well 106, such as estimated values of permeability, porosity, water saturation, oil saturation, or the like for the portion of the formation 104 surrounding the wellbore 120. As described, simulations may be run for various combinations of candidate well operating flowrates and candidate lateral lengths (L), using the well characteristics 152, to identify operational well parameters 154 for the well 106. The operational well parameters 154 may include, for example, an "optimized" lateral length (L) of the horizontal wellbore portion 132 of the well 106 and a corresponding well operating flowrate. In some embodiments, the well 106 may be created and operated in accordance with the operational well parameters 154. For example, if the operational well parameters 154 define a lateral length (L) of 1200 m in association with a well operating flowrate (q) of 6000 STB/day, the control system 122 (or another operator of the well 106) may control a drilling operation to drill the wellbore 120 with a horizontal wellbore portion 132 having a lateral length (L) of about 1200 m and control the well 106 to operate at a production flowrate (q) of about 6000 STB/day.

In some embodiments, determining an optimized lateral length for the well 106 includes the following: (a) identifying candidate well parameters 150, including: (i) a well location for the well 106, (ii) one or more candidate well production rates (q) for the well 106, and (iii) candidate lateral lengths (L) for the well 106; (b) conducting, for each combination of the one or more candidate well production rates and the candidate lateral lengths, a well simulation of a hydrocarbon well located at the well location, having a horizontal wellbore portion of a lateral length that corresponds to the candidate lateral length, and operating at production rate corresponding to the candidate well production rate, to determine (i) a gas breakthrough time ($t_{gb}$) that corresponds to an estimated time of gas breakthrough into the wellbore of the simulated well, and (ii) a GBPI for the simulated well that corresponds to a PI of the simulated well at the gas breakthrough time ($t_{gb}$); (c) for each of the one or more candidate well production rates: (i) determining, based on the GBPIs for the combinations of the candidate well production rate and the candidate lateral lengths, a relationship of GBPI versus lateral length for the candidate well production rate; and (ii) determining, based on the relationship of GBPI versus lateral length for the candidate well production rate, an "optimized" lateral length for the candidate well production rate that corresponds to a lateral length at which a ratio of a change of the GBPI for the well versus a corresponding change in the lateral length of the wellbore for the candidate well production rate is below a GBPI-length threshold. The well 106 may be drilled into the reservoir 102 at the well location and having a lateral length (L) that corresponds to the optimized lateral length determined, and the well 106 may be operated at a well production rate corresponding to the optimized lateral length.

Figure 2:
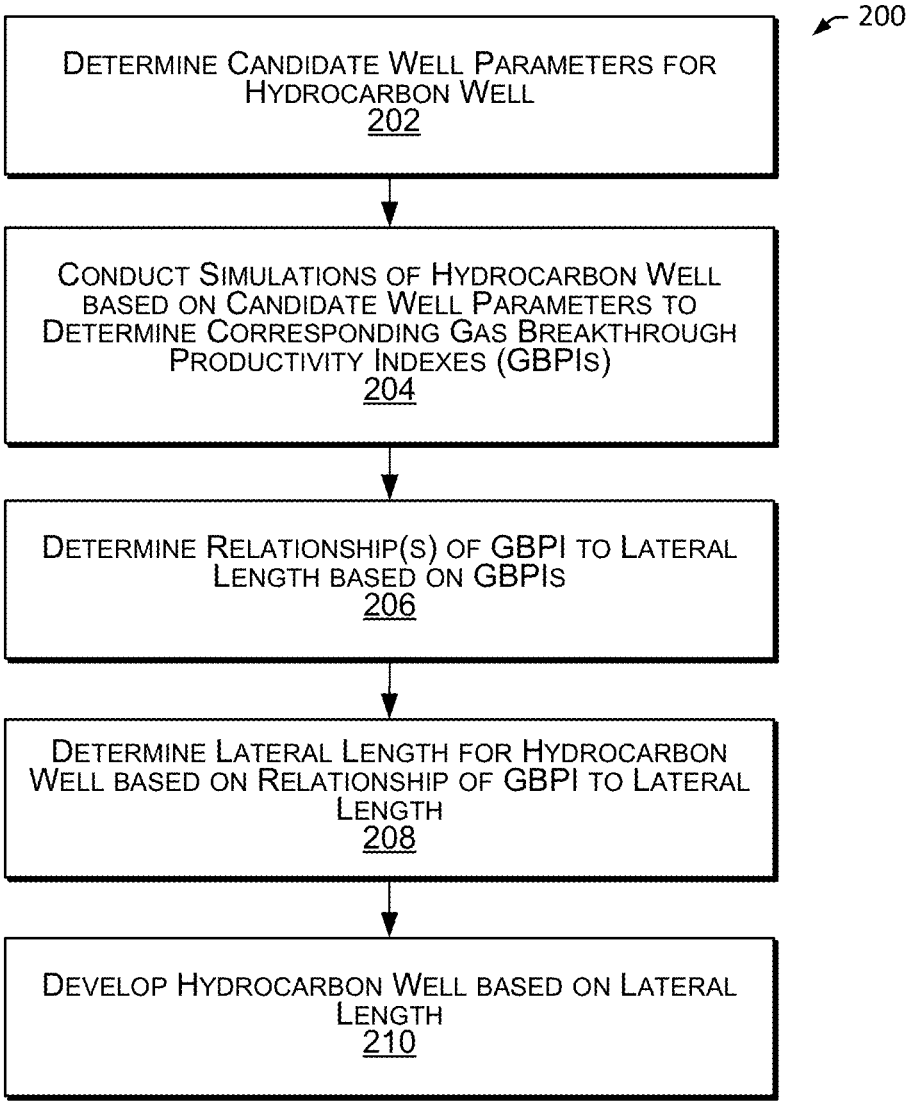
FIG. 2 is a flowchart that illustrates a method of determining and employing an optimized horizontal well lateral length, in accordance with one or more embodiments.

FIG. 2 is a flowchart that illustrates a method 200 of determining and employing an optimized horizontal well lateral length, in accordance with one or more embodiments. In the context of the well 106, the operations of method 200 may be performed, for example, by the well control system 122 (or another operator of the well 106). For example, a processing module of the well control system 122 may perform one or more of the data processing operations described, such as those directed to determining candidate well parameters 150, determining well characteristics 152, and determining associated operational well parameters 154, including, for example, an optimized horizontal well lateral length and a corresponding well production rate. A well operator, such as a control module of the well control system 122 (or well personnel), may develop the reservoir 102 based on the operational well parameters 154. For example, a control module of the well control system 122 (or well personnel) may develop the reservoir 102 by controlling a well drilling system to drill the wellbore 120 of the well 106 with a trajectory having a lateral length that corresponds to the optimized horizontal well lateral length (L) specified in the operational well parameters 154, and controlling a well production system to operate the well 106 at the corresponding well production rate specified in the operational well parameters 154.

In some embodiments, method 200 includes determining candidate well parameters for a hydrocarbon well (block 202). The candidate well parameters for a hydrocarbon well may include a candidate well location, one or more candidate well production rates, and candidate lateral lengths for the well. For example, determining candidate well parameters for the well 106 may include the control system 122 (or another operator of the well 106) identifying candidate well parameters 150 that include the following: (a) a candidate well location that defines (i) a geographic location (e.g., defined by latitude and longitude coordinates) at which an up-hole end 124 of the wellbore 120 of the well 106 will penetrate the Earth's surface 108; and (ii) a trajectory of a vertical portion of the wellbore of the well 106 (e.g., including a depth to the heel 138 of the wellbore of the well 106); (b) candidate well operating flowrates of 6000 STB/d, 8000 STB/d, 10000 STB/d, and 12000 STB/d for the well 106; and (c) candidate lateral lengths of 500 m, 1000 m, 1500 m, and 2000 m for the well 106. Although a given number of example candidate well operating flowrates and candidate lateral lengths are provided for the purpose of illustration, the candidate well operating flowrates may include one or more candidate well operating flowrates, and the candidate lateral lengths may include two or more candidate lateral lengths.

In some embodiments, method 200 includes conducting simulations of the hydrocarbon well based on the candidate well parameters to determine corresponding gas breakthrough productivity indexes (GBPIs) (block 204). This may include conducting, for each combination of the one or more candidate well production rates and the candidate lateral lengths of the candidate well parameters, a simulation of a hydrocarbon well located at the well location of the candidate well parameters, having a vertical wellbore portion corresponding to the trajectory defined by the of the candidate well parameters, having a horizontal wellbore portion having a lateral length that corresponds to the candidate lateral length, and operating at a production rate corresponding to the candidate well production rate, to determine (i) a gas breakthrough time ($t_{gb}$) that corresponds to an estimated time of gas breakthrough into the wellbore of the simulated well, and (ii) a GBPI for the simulated well that corresponds to a PI of the simulated well at the gas breakthrough time ($t_{gb}$). Continuing with the above example, conducting a simulation of the well 106 based on the candidate well parameters 150 may include the control system 122 (or another operator of the well 106) conducting, for each combination of the one or more candidate well production rates and the candidate lateral lengths of the candidate well parameters (e.g., for each of the following combinations: [500 m, 6000 STB/d], [1000 m, 6000 STB/d], [1500 m, 6000 STB/d], [2000 m, 6000 STB/d], [500 m, 8000 STB/d], [1000 m, 8000 STB/d], [1500 m, 8000 STB/d] . . . [1500 m, 12000 STB/d], [2000 m, 12000 STB/d]), a simulation of a hydrocarbon well located at the well location of the candidate well parameters 150, having a vertical wellbore portion corresponding to the trajectory defined by the of the candidate well parameters 150, having a horizontal wellbore portion having a lateral length that corresponds to the candidate lateral length, and operating at a production rate corresponding to the candidate well production rate, to determine (i) a gas breakthrough time ($t_{gb}$) that corresponds to an estimated time of gas breakthrough into the wellbore of the simulated well, and (ii) a GBPI for the simulated well that corresponds to a PI of the simulated well at the gas breakthrough time ($t_{gb}$). This may include for example, simulating the well with a well a lateral length of 500 m and a production rate of 6000 STB/d to determine an estimated (or "simulated") gas breakthrough time ($t_{gb}$) of about 1 year and a corresponding GBPI of about 15, simulating the well with a well a lateral length of 1000 m and a production rate of 6000 STB/d to determine an estimated gas breakthrough time ($t_{gb}$) of about 2 years and a corresponding GBPI of about 23, and so forth, to generate four GBPI-length data points for each of the four candidate lateral lengths. The PI of a well may be a ratio of the total liquid surface flowrate to the pressure drawdown at a midpoint of a producing interval of the wellbore of a well. The PI (J) for a well may be determined according to the following equation:

$$J = \frac{Q}{P_e - P_{wf}} \tag{1}$$

where:

J=Productivity Index, STB/day/psi (pounds per square inch);

Q=Surface flowrate at standard conditions, STB/D;

$P_e$=External boundary radius pressure, psi;

$P_{wf}$=Well sand-face mid-perf pressure, psi.

Figure 3A:
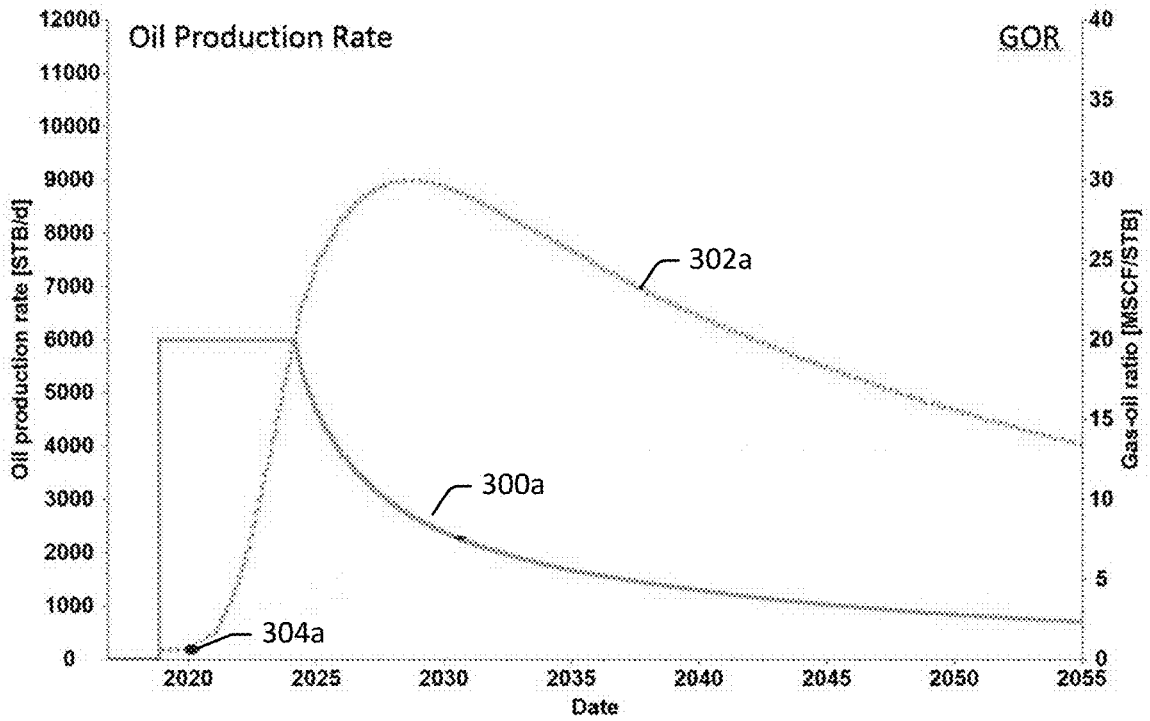
FIGS. 3A and 3B are diagrams that illustrate example simulated performances of wells of different lengths in accordance with one or more embodiments.
Figure 3B:
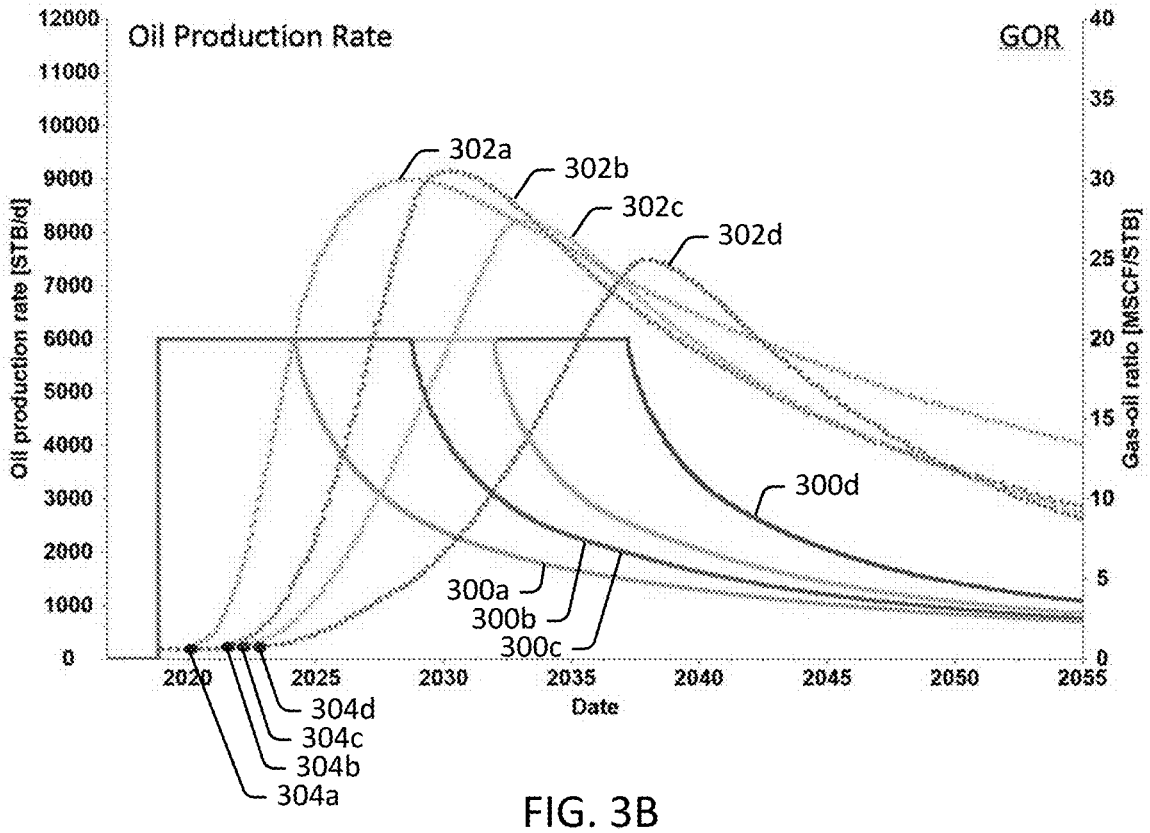

FIG. 3A is a diagram that illustrates example simulation results for a simulation of a well having a lateral length of 500 m and a production rate of 6000 STB/d in accordance with one or more embodiments. The simulation results include a production rate curve 300*a* and a corresponding gas-oil ratio curve 302*a* for the lateral length of 500 m and a production rate of 6000 STB/d. The gas-oil ratio (GOR) curve 302*a* includes an indication of a corresponding breakthrough point 304*a* at about the year 2020 (e.g., approximately 1 year after production starts in approximately 2019). Similar simulation results may be generated for each of the candidate lateral lengths. FIG. 3B is a diagram that illustrates example simulation results for a simulation of the well with a lateral lengths of 500 m, 1000 m, 1500 m and 2000 m and a production rate of 6000 STB/d in accordance with one or more embodiments. The simulation results include respective production rate curves 300*a*, 300*b*, 300*c*, and 300*d* (and a corresponding gas-oil ratio curves 302*a*, 302*b*, 302*c* and 302*d*) for the respective lateral lengths of 500 m, 1000 m, 1500 m and 2000 m and a production rate of 6000 STB/d. Each of the gas-oil ratio curves 302*a*, 302*b*, 302*c* and 302*d* includes a corresponding indication of a breakthrough point 304*a*, 304*b*, 304*c* or 304*d*. A similar set of simulation results may be generated for each of the candidate production rates. The breakthrough points 304*a*, 304*b*, 304*c* and 304*d* may be determined based on a point at which the GOR exceeds a GOR threshold value that is indicative of gas breaking into the wellbore of the well.

In some embodiments, method 200 includes determining relationship(s) of GBPI to lateral length for the hydrocarbon well based on GBPIs (block 206). This may include determining, for each candidate production rate, a GBPI-length curve that represents a relationship of the GBPI values for the well to the lateral lengths of the well for the production rate, determined based on the simulations of the well for different lateral lengths at the candidate production rate. Continuing with the above example, determining relationships of GBPI to lateral length for the well 106 may include the control system 122 (or another operator of the well 106) determining, based on the simulation results for each the candidate well productions rates (e.g., for each of the candidate production rates of 6000 STB/d, 8000 STB/d, 10000 STB/d, and 12000 STB/d), a corresponding GBPI-length curve that represents a relationship of the GBPI values for the well 106 to the lateral lengths of the well 106 for the production rate, determined based on the simulations of the well for the different lateral lengths at the candidate production rate.

Figure 4A:
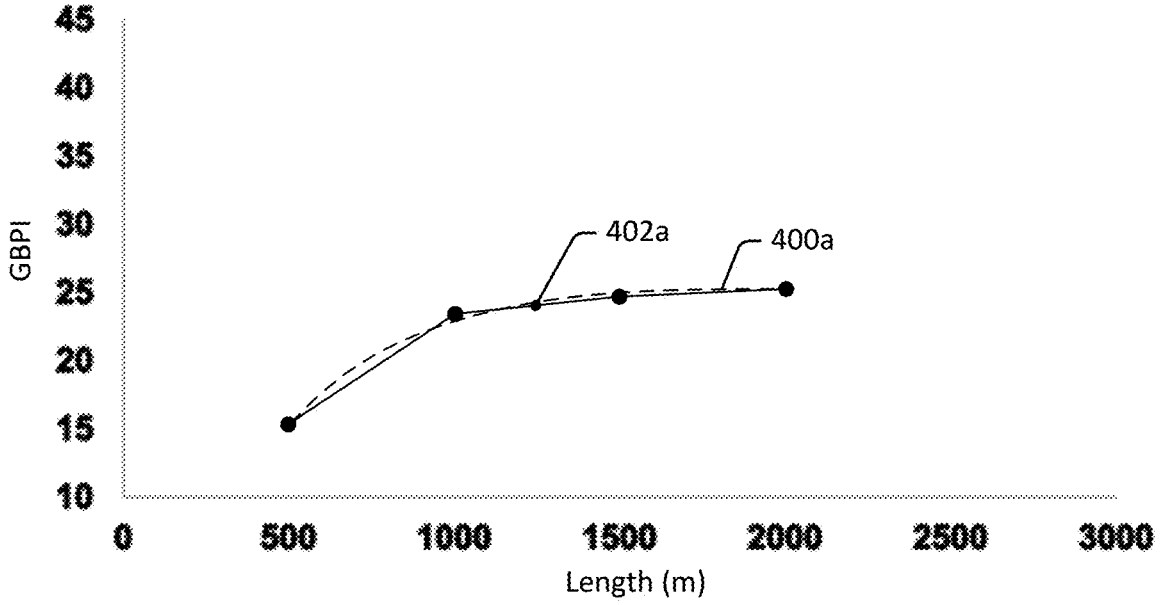
FIGS. 4A and 4B are diagrams that illustrate example relationships of gas breakthrough productivity indexes (GBPIs) versus horizontal well lateral lengths in accordance with one or more embodiments.
Figure 4B:
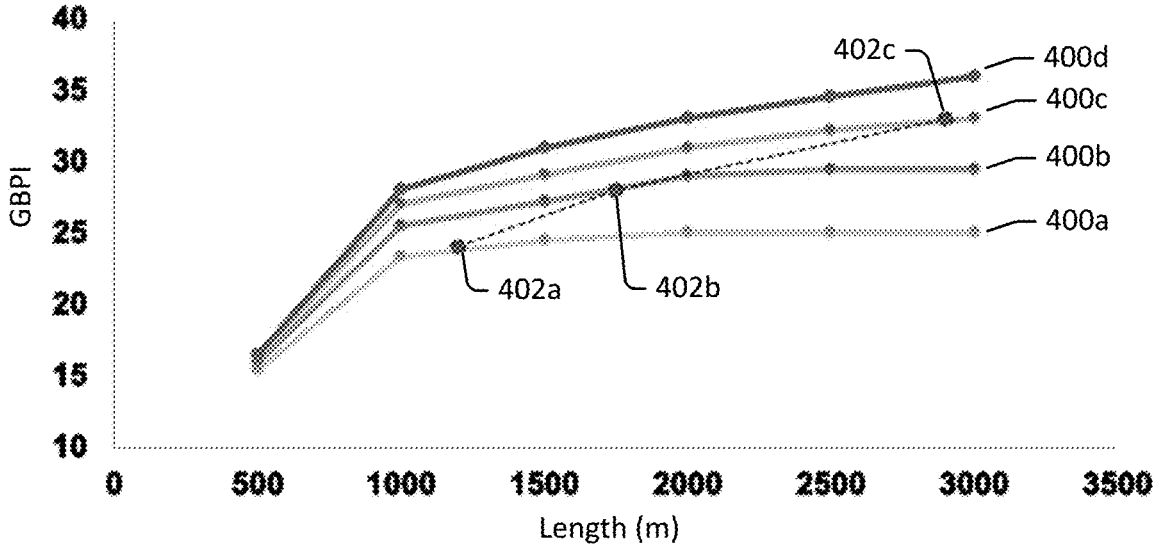

FIG. 4A is a diagram that illustrates an example relationship of GBPI to lateral length that is based on the results of the simulation of the well having a production rate of 6000 STB/d in accordance with one or more embodiments. The relationship includes a GBPI-length curve 400*a* defined by the GBPI values for the production rate of 6000 STB/d. The respective GBPI values are approximately 15, 24.0, 24.9, and 25.0 for the lateral lengths of 500 m, 1000 m, 1500 m and 2000 m, respectively. The GBPI-length curve 400*a* may be, for example, a segmented line that passes through each data point (e.g., as illustrated by the solid line segments) or a best fit curve for the data points (e.g., as illustrated by the solid line). Similar simulation results may be generated for each of the candidate production rates. FIG. 4B is a diagram that illustrates example relationships of GBPI to lateral length that are based on the results of the simulation of the well 106 with lateral lengths of 500 m, 1000 m, 1500 m, 2000 m, 2500 m, and 3000 m and production rates of 6000 STB/d, 8000 STB/d, 10000 STB/d, and 12000 STB/d in accordance with one or more embodiments. The relationships includes a respective GBPI-length curve 400*a*, 400*b*, 400*c*, and 400*d* for each of the production rates of 6000 STB/d, 8000 STB/d, 10000 STB/d, and 12000 STB/d.

In some embodiments, method 200 includes determining a lateral length for the hydrocarbon well based on relationship(s) of GBPI to lateral length for the well (block 208). This may include determining, for each candidate production rate, a lateral length for the candidate well production rate that corresponds to a lateral length at which a ratio of a change of the GBPI for the well versus a corresponding change in the lateral length of the wellbore for the candidate well production rate falls below a GBPI-length threshold. This may include, for example, determining a lateral length that corresponds to a point at which the slope of the GBPI-length curve is less than a specified GBPI-length threshold (e.g., less than 1 GPBI/250 m)). Where the GBPI-length curve is a segmented line, the point at which the slope of the GBPI-length curve is less than a specified GBPI-length threshold may be a midpoint of first line segment that has a slope that is less than the specified GBPI-length threshold. Where the GBPI-length curve is a best-fit line, the point at which the slope of the GBPI-length curve is less than a specified GBPI-length threshold may be the first point on the best-fit line that has a slope that is less than the specified GBPI-length threshold. Such a point may correspond to a lateral length above which the performance of the well (e.g., indicated by the GBPI) plateaus, such that it does not significantly increase per unit length of increase in the lateral length. Continuing with the above example and the GBPI-length curve of FIG. 4A, determining a lateral length for the well 106 at a production rate of 6000 STB/d may include the control system 122 (or another operator of the well 106) determining, based on the GBPI-length curve 400*a* a point 402*a* corresponding to a point at which the slope of the GBPI-length curve is less than 1/250, and identifying a corresponding lateral length of about 1250 m for the well operating at a production rate of 6000 STB/d. Continuing with the above example and the GBPI-length curves of FIG. 4B, determining a lateral length for the well 106 at the production rates of 6000 STB/d, 8000 STB/d, 10000 STB/d, and 12000 STB/d may include the control system 122 (or another operator of the well 106) determining, based on the GBPI-length curves 400*a*, 400*b*, 400*c* and 400*d*, respective points 402*a*, 402*b*, and 402*c* that corresponds to a point at which the slope of the GBPI-length curve is less than 1/250, and identifying corresponding lateral lengths of about 1250 m, 1750 m and 2900 m for the well operating at respective production rates of 6000 STB/d, 8000 STB/d, and 10000 STB/d. Notably, for a production rate of 12000 STB/d, it may be determined that an optimized lateral length would be greater than 3000 m.

In some embodiments, method 200 includes developing a hydrocarbon well based on the lateral length (block 210). This may include drilling a well at the well location specified by the candidate well parameters, having a vertical wellbore portion corresponding to the trajectory defined by the of the candidate well parameters, and having a horizontal wellbore portion having a lateral length that corresponds to the determined lateral length for a given one of the candidate production rates, and operating the well at a production rate corresponding to the given candidate production rate. Continuing with the above example with a determined lateral length of about 1250 m for a production rate of 6000 STB/d, developing the well 106 based on the lateral length may include drilling the well 106 with a wellbore 120 trajectory defined by a vertical wellbore portion 130 having a trajectory corresponding to a vertical trajectory defined by the of the candidate well parameters 150 and having a horizontal wellbore portion 132 having a lateral length (L) of about 1250 m. In some embodiments, operational parameters for one or more additional wells may be determined in a similar manner, and the one or more wells may be developed to create multiple wells having optimized lateral lengths. For example, operational parameters for a second well located adjacent the well 106, including a lateral length of about 1000 m and a production rate of 6500 STB/d, may be determined. The second well may be drilled at the location adjacent the well 106 with a horizontal wellbore portion having a lateral length (L) of about 1000 m and the second well may be operated at production rate of 6500 STB/d.

Figure 5A:
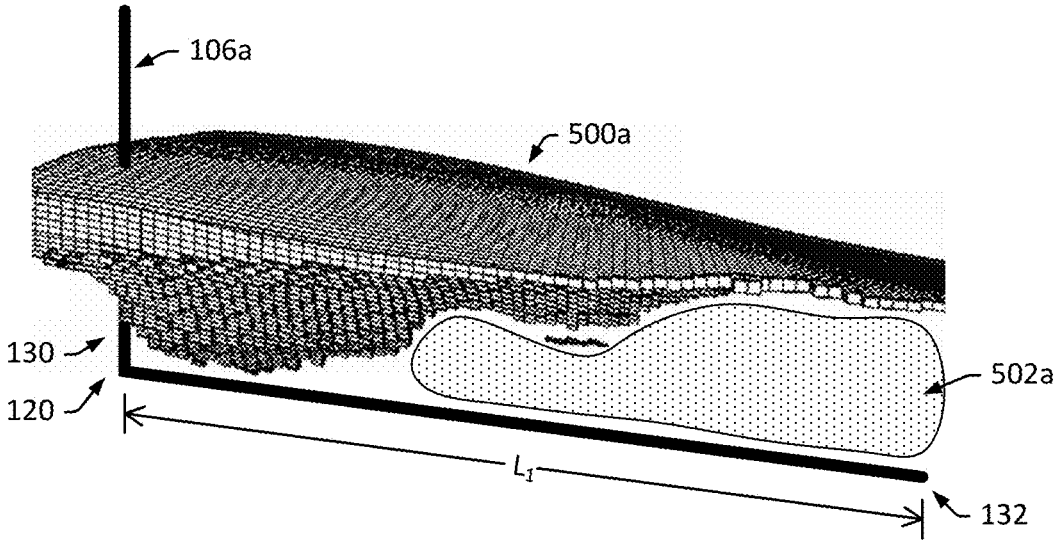
FIGS. 5A-5C are diagrams that illustrate example reservoir sweeps for different well configurations in accordance with one or more embodiments.
Figure 5B:
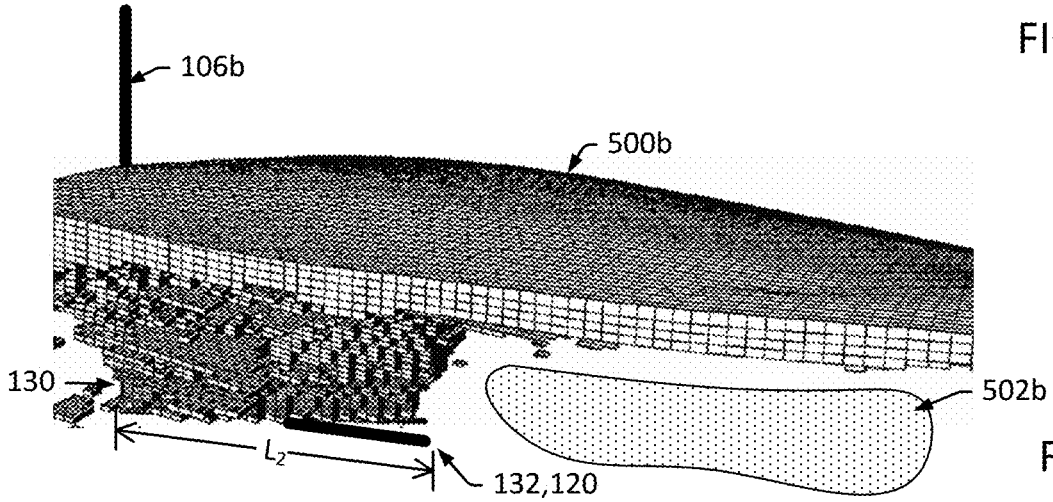
Figure 5C:
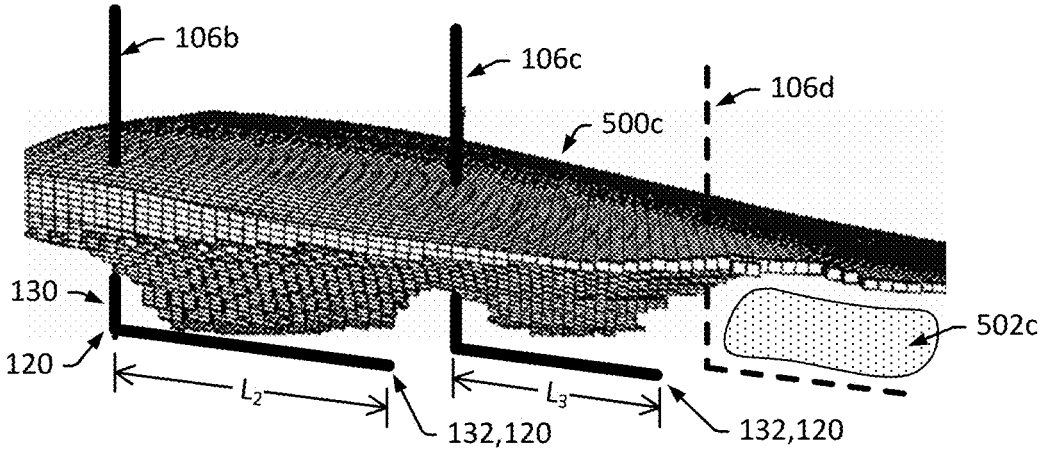

FIGS. 5A-5C are diagrams that illustrate improved sweep efficiency of developing wells having "optimized" lateral lengths in accordance with one or more embodiments. FIG. 5A illustrates a horizontal well 106*a* having a relatively long lateral length (e.g., $L_1$=2500 m). FIG. 5B illustrates a single horizontal well 106*b* having a relatively short lateral length L (e.g., $L_2$=1250 m). FIG. 5C illustrates two horizontal wells, including the well 106*b* accompanied by a second well 106*c* that also has relatively short lateral length (e.g., $L_2$=1250 and $L_3$=1000 m). The grid cell portions 500*a*, 500*b* and 500*c* represent areas of injection gas/water (e.g., the location of a gas cap) at or near a gas breakthrough time, determined based on simulations of the respective wells 106*a*, 106*b* and 106*c*. The areas between the grid cell portions 500*a*, 500*b* and 500*c* and the wellbores 120 may represent areas of unrecovered (or "un-swept") oil. For example, the grid cell portion 500*a* of FIG. 5A may represent a simulated location of a pocket of injected gas/water (e.g., the location of a portion/pocket of the gas cap) at the time when a portion of the pocket of injected gas/water is determined to reach the wellbore 120 of the well 106*a*. Notably, the well 106*a* is expected to leave a relatively large pocket of un-swept oil 502*a*. The grid cell portion 500*b* of FIG. 5B may represent a simulated location of a pocket of injected gas/water at a time when a portion of the pocket of injected gas/water is determined to reach the wellbore 120 of the well 106*b*. Notably, the well 106*b* is expected to efficiently extract a relatively large portion of the oil in the portion of the formation near the wellbore 120 of the well 106*b*, and is expected to leave a relatively small pocket of un-swept oil 502*b* that may be reached, for example, by way of a second well (e.g., well 106*c* that be drilled). The grid cell portion 500*c* of FIG. 5C may represent a simulated location of a pocket of injected gas/water at a time when a portion of the pocket of injected gas/water is determined to reach the wellbore 120 of the well 106*b*. Notably, the wells 106*b* and 106*c* are expected to efficiently extract a relatively large portion of the oil in the portion of the formation near the wellbores 120 of the well 106*b* and 106*c*, and are expected to leave a relatively small pocket of un-swept oil 502*c* that may be reached, for example, by way of a third well (e.g., a well 106*d* that may be drilled). The lateral lengths of each of the wells 106*b*, 106*c* and 106*d* may be determined, for example, by way of the techniques described here.

Figure 6:
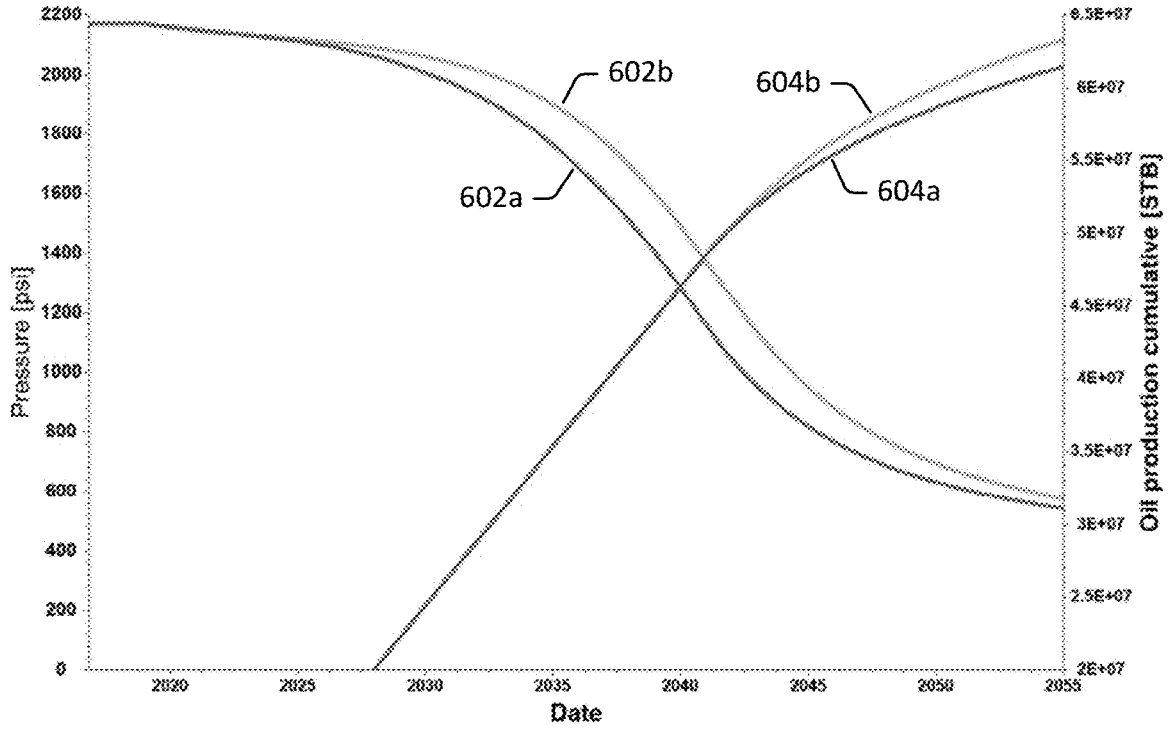
FIG. 6 is a diagram that illustrate example well performances in accordance with one or more embodiments.

FIG. 6 is a diagram that illustrates an example of enhanced hydrocarbon recovery that can achieved in accordance with one or more embodiments. The illustrated embodiment includes operating pressure curves 602*a* and 602*b* and cumulative oil production curves 604*a* and 604*b*. The operating pressure curve 602*a* and the cumulative oil production curve 604*a* may represent a decrease in well pressure and cumulative oil production, respectively, for a relatively long well (e.g., well 106*a* of FIG. 5A). The operating pressure curve 602*b* and the cumulative oil production curve 604*b* may represent a decrease in well pressure and cumulative oil production, respectively, for multiple relatively short wells employed in place of the relatively long well (e.g., wells 106*b* and 106*c* of FIG. 5C). As illustrated, in the case of the multiple relatively short wells of optimized length, the decrease in well pressure may be delayed and the overall cumulative oil production may be increased relative to that for the relatively long well.

Figure 7:
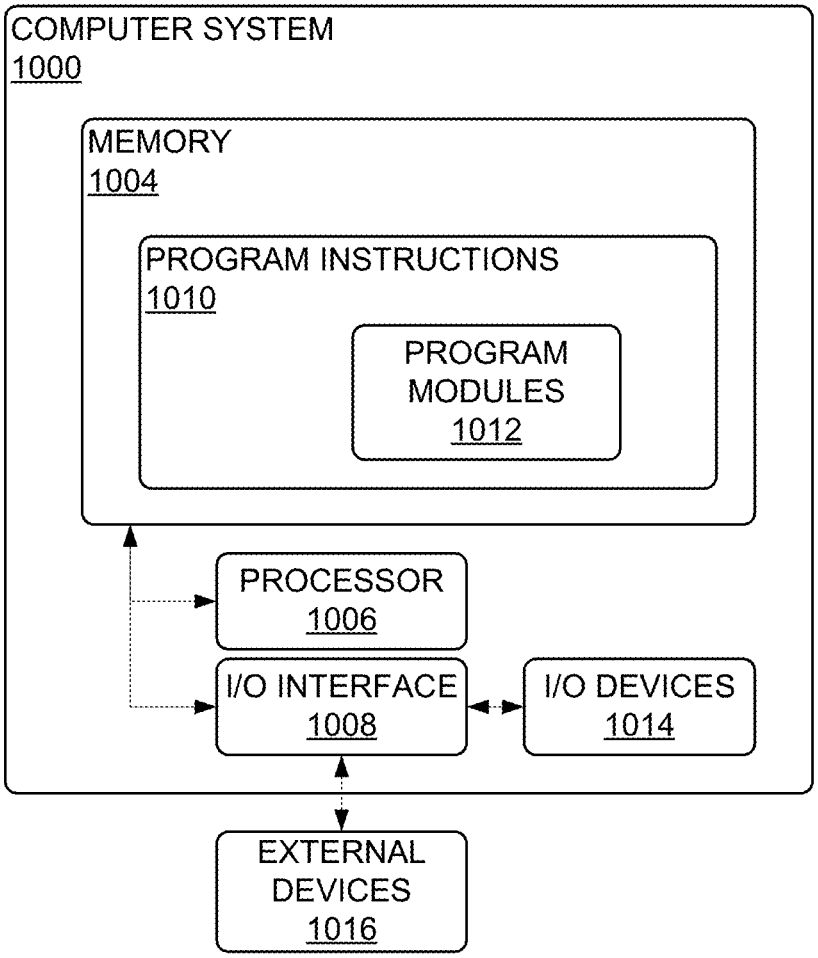
FIG. 7 is a diagram that illustrates an example computer system in accordance with one or more embodiments.

FIG. 7 is a diagram that illustrates an example computer system (or "system") 1000 in accordance with one or more embodiments. In some embodiments, the system 1000 is a programmable logic controller (PLC). The system 1000 may include a memory 1004, a processor 1006 and an input/output (I/O) interface 1008. The memory 1004 may include non-volatile memory (e.g., flash memory, read-only memory (ROM), programmable read-only memory (PROM), erasable programmable read-only memory (EPROM), electrically erasable programmable read-only memory (EEPROM)), volatile memory (e.g., random access memory (RAM), static random access memory (SRAM), synchronous dynamic RAM (SDRAM)), or bulk storage memory (e.g., CD-ROM or DVD-ROM, hard drives). The memory 1004 may include a non-transitory computer-readable storage medium having program instructions 1010 stored thereon. The program instructions 1010 may include program modules 1012 that are executable by a computer processor (e.g., the processor 1006) to cause the functional operations described, such as those described with regard to the well control system 122 or the method 200.

The processor 1006 may be any suitable processor capable of executing program instructions. The processor 1006 may include a central processing unit (CPU) that carries out program instructions (e.g., the program instructions of the program modules 1012) to perform the arithmetical, logical, or input/output operations described. The processor 1006 may include one or more processors. The I/O interface 1008 may provide an interface for communication with one or more I/O devices 1014, such as a joystick, a computer mouse, a keyboard, or a display screen (for example, an electronic display for displaying a graphical user interface (GUI)). The I/O devices 1014 may include one or more of the user input devices. The I/O devices 1014 may be connected to the I/O interface 1008 by way of a wired connection (e.g., an Industrial Ethernet connection) or a wireless connection (e.g., a Wi-Fi connection). The I/O interface 1008 may provide an interface for communication with one or more external devices 1016. In some embodiments, the I/O interface 1008 includes one or both of an antenna and a transceiver. In some embodiments, the external devices 1016 include well drilling systems, logging tools, lab test systems, well operating systems, well pressure sensors, or well flowrate sensors.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments. It is to be understood that the forms of the embodiments shown and described herein are to be taken as examples of embodiments. Elements and materials may be substituted for those illustrated and described herein, parts and processes may be reversed or omitted, and certain features of the embodiments may be utilized independently, all as would be apparent to one skilled in the art after having the benefit of this description of the embodiments. Changes may be made in the elements described herein without departing from the spirit and scope of the embodiments as described in the following claims. Headings used herein are for organizational purposes only and are not meant to be used to limit the scope of the description.

It will be appreciated that the processes and methods described herein are example embodiments of processes and methods that may be employed in accordance with the techniques described herein. The processes and methods may be modified to facilitate variations of their implementation and use. The order of the processes and methods and the operations provided may be changed, and various elements may be added, reordered, combined, omitted, modified, and so forth. Portions of the processes and methods may be implemented in software, hardware, or a combination of software and hardware. Some or all of the portions of the processes and methods may be implemented by one or more of the processors/modules/applications described here.

As used throughout this application, the word "may" is used in a permissive sense (i.e., meaning having the potential to), rather than the mandatory sense (i.e., meaning must). The words "include," "including," and "includes" mean including, but not limited to. As used throughout this application, the singular forms "a", "an," and "the" include plural referents unless the content clearly indicates otherwise. Thus, for example, reference to "an element" may include a combination of two or more elements. As used throughout this application, the term "or" is used in an inclusive sense, unless indicated otherwise. That is, a description of an element including A or B may refer to the element including one or both of A and B. As used throughout this application, the phrase "based on" does not limit the associated operation to being solely based on a particular item. Thus, for example, processing "based on" data A may include processing based at least in part on data A and based at least in part on data B, unless the content clearly indicates otherwise. As used throughout this application, the term "from" does not limit the associated operation to being directly from. Thus, for example, receiving an item "from" an entity may include receiving an item directly from the entity or indirectly from the entity (e.g., by way of an intermediary entity). Unless specifically stated otherwise, as apparent from the discussion, it is appreciated that throughout this specification discussions utilizing terms such as "processing," "computing," "calculating," "determining," or the like refer to actions or processes of a specific apparatus, such as a special purpose computer or a similar special purpose electronic processing/computing device. In the context of this specification, a special purpose computer or a similar special purpose electronic processing/computing device is capable of manipulating or transforming signals, typically represented as physical, electronic or magnetic quantities within memories, registers, or other information storage devices, transmission devices, or display devices of the special purpose computer or similar special purpose electronic processing/computing device.

What is claimed is:

1. A method of developing a hydrocarbon well, the method comprising:

identifying candidate well parameters for a hydrocarbon well, the candidate well parameters comprising:

a location for the hydrocarbon well;

a well production rate for the hydrocarbon well; and candidate horizontal wellbore lateral lengths for a horizontal portion of a wellbore of the hydrocarbon well;

conducting, for each candidate horizontal wellbore lateral length of the candidate horizontal wellbore lateral lengths, a simulation of a hydrocarbon well located at the location and having a wellbore having a horizontal wellbore portion of a lateral length that corresponds to the candidate horizontal wellbore lateral length and operating at the well production rate, the simulation comprising:

determining a gas breakthrough into the wellbore of the simulated hydrocarbon well;

determining a gas breakthrough time that corresponds to the time of the gas breakthrough into the wellbore of the simulated hydrocarbon well; and determining a gas breakthrough productivity index (GBPI) for the simulated hydrocarbon well that corresponds to a productivity index (PI) of the simulated hydrocarbon well at the gas breakthrough time;

determining, based on the gas breakthrough productivity indexes (GBPIs) for the candidate horizontal wellbore lateral lengths and the well production rate, a relationship of GBPI to horizontal wellbore lateral length;

determining, based on the relationship of GBPI to horizontal wellbore lateral length, an optimized horizontal wellbore lateral length for the production rate that corresponds to a horizontal wellbore lateral length at which a ratio of a change of the GBPI for the simulated hydrocarbon well to a corresponding change in the horizontal wellbore lateral length is below a GBPI-length threshold; and drilling, using a drill bit boring through a formation at the location, the hydrocarbon well having a wellbore having a horizontal wellbore portion having a lateral length that corresponds to the optimized horizontal wellbore lateral length.

2. The method of claim 1, wherein the candidate well parameters comprises a second well production rate for the hydrocarbon well, and wherein the method further comprises:

conducting, for each candidate horizontal wellbore lateral length of the candidate horizontal wellbore lateral lengths, a simulation of a hydrocarbon well located at the location and having a wellbore having a horizontal wellbore portion of a lateral length that corresponds to the candidate horizontal wellbore lateral length and operating at the second well production rate, the simulation comprising:

determining a gas breakthrough into the wellbore of the simulated hydrocarbon well;

determining a gas breakthrough time that corresponds to the time of the gas breakthrough into the wellbore of the simulated hydrocarbon well; and determining a GBPI for the simulated hydrocarbon well that corresponds to a PI of the simulated hydrocarbon well at the gas breakthrough time;

determining, based on the gas breakthrough productivity indexes (GBPIs) for the candidate horizontal wellbore lateral lengths and the second production rate, a second relationship of GBPI to horizontal wellbore lateral length; and determining, based on the second relationship of GBPI to horizontal wellbore lateral length, an optimized horizontal wellbore lateral length for the second production rate that corresponds to a horizontal wellbore lateral length at which a ratio of a change of the GBPI for the hydrocarbon well to a corresponding change in the horizontal wellbore lateral length is below the GBPI-length threshold.

3. The method of claim 1, wherein determining the optimized horizontal wellbore lateral length for the production rate that corresponds to a horizontal wellbore lateral length at which a ratio of a change of the GBPI for the hydrocarbon well to a corresponding change in the horizontal wellbore lateral length is below the GBPI-length threshold comprises:

determining a curve for the relationship of GBPI to horizontal wellbore lateral length; and determining a horizontal wellbore lateral length that corresponds to a point at which a slope of the curve falls below the GBPI-length threshold.

4. The method of claim 1, wherein the horizontal wellbore lateral length at which a ratio of a change of the GBPI for the hydrocarbon well to a corresponding change in the horizontal wellbore lateral length is below the GBPI-length threshold corresponds to a lateral length above which the PI for the hydrocarbon well exhibits a plateau.

5. The method of claim 1, further comprising operating, by a well control system, the hydrocarbon well at the production rate, wherein the operating comprises receiving a production rate from a well flowrate sensor.

6. The method of claim 1, further comprising:

identifying second candidate well parameters for a second hydrocarbon well, the second candidate well parameters comprising:

a second location for the second hydrocarbon well;

a second well production rate for the second hydrocarbon well; and second candidate horizontal wellbore lateral lengths for a horizontal portion of a wellbore of the second hydrocarbon well;

conducting, for each candidate horizontal wellbore lateral length of the second candidate horizontal wellbore lateral lengths, a simulation of a hydrocarbon well located at the second location and having a wellbore having a horizontal wellbore portion of a lateral length that corresponds to the candidate horizontal wellbore lateral length and operating at the second well production rate, the simulation comprising:

determining a gas breakthrough into the wellbore of the simulated hydrocarbon well;

determining a gas breakthrough time that corresponds to the time of the gas breakthrough into the wellbore of the simulated hydrocarbon well; and determining a GBPI for the simulated hydrocarbon well that corresponds to a productivity index (PI) of the simulated hydrocarbon well at the gas breakthrough time;

determining, based on the GBPIs for the second candidate horizontal wellbore lateral lengths and the second well production rate, a relationship of GBPI to horizontal wellbore lateral length;

determining, based on the relationship of GBPI to horizontal wellbore lateral length, a second optimized horizontal wellbore lateral length for the second production rate that corresponds to a horizontal wellbore lateral length at which a ratio of a change of the GBPI for the simulated hydrocarbon well to a corresponding change in the horizontal wellbore lateral length is below a GBPI-length threshold; and drilling, at the second location, the second hydrocarbon well having a horizontal wellbore lateral length that corresponds to the second optimized horizontal wellbore lateral length.

7. A system for developing a hydrocarbon well, the system comprising:

a processor; and a non-transitory computer readable storage medium comprising program instructions stored thereon that are executable by the processor to perform the following operations:

identifying candidate well parameters for a hydrocarbon well, the candidate well parameters comprising:

a location for the hydrocarbon well;

a well production rate for the hydrocarbon well; and candidate horizontal wellbore lateral lengths for a horizontal portion of a wellbore of the hydrocarbon well;

conducting, for each candidate horizontal wellbore lateral length of the candidate horizontal wellbore lateral lengths, a simulation of a hydrocarbon well located at the location and having a wellbore having a horizontal wellbore portion of a lateral length that corresponds to the candidate horizontal wellbore lateral length and operating at the well production rate, the simulation comprising:

determining a gas breakthrough into the wellbore of the simulated hydrocarbon well;

determining a gas breakthrough time that corresponds to the time of the gas breakthrough into the wellbore of the simulated hydrocarbon well; and determining a gas breakthrough productivity index (GBPI) for the simulated hydrocarbon well that corresponds to a productivity index (PI) of the simulated hydrocarbon well at the gas breakthrough time;

determining, based on the gas breakthrough productivity indexes (GBPIs) for the candidate horizontal wellbore lateral lengths and the well production rate, a relationship of GBPI to horizontal wellbore lateral length; and determining, based on the relationship of GBPI to horizontal wellbore lateral length, an optimized horizontal wellbore lateral length for the production rate that corresponds to a horizontal wellbore lateral length at which a ratio of a change of the GBPI for the simulated hydrocarbon well to a corresponding change in the horizontal wellbore lateral length is below a GBPI-length threshold; and drilling, using a drill bit boring through a formation at the location, the hydrocarbon well having a wellbore having a horizontal wellbore portion having a lateral length that corresponds to the optimized horizontal wellbore lateral length.

8. The system of claim 7, wherein the candidate well parameters comprises a second well production rate for the hydrocarbon well, and wherein the operations further comprise:

conducting, for each candidate horizontal wellbore lateral length of the candidate horizontal wellbore lateral lengths, a simulation of a hydrocarbon well located at the location and having a wellbore having a horizontal wellbore portion of a lateral length that corresponds to the candidate horizontal wellbore lateral length and operating at the second well production rate, the simulation comprising:

determining a gas breakthrough into the wellbore of the simulated hydrocarbon well;

determining a gas breakthrough time that corresponds to the time of the gas breakthrough into the wellbore of the simulated hydrocarbon well; and determining a GBPI for the simulated hydrocarbon well that corresponds to a PI of the simulated hydrocarbon well at the gas breakthrough time;

determining, based on the gas breakthrough productivity indexes (GBPIs) for the candidate horizontal wellbore lateral lengths and the second production rate, a second relationship of GBPI to horizontal wellbore lateral length; and determining, based on the second relationship of GBPI to horizontal wellbore lateral length, an optimized horizontal wellbore lateral length for the second production rate that corresponds to a horizontal wellbore lateral length at which a ratio of a change of the GBPI for the hydrocarbon well to a corresponding change in the horizontal wellbore lateral length is below the GBPI-length threshold.

9. The system of claim 7, wherein determining the optimized horizontal wellbore lateral length for the production rate that corresponds to a horizontal wellbore lateral length at which a ratio of a change of the GBPI for the hydrocarbon well to a corresponding change in the horizontal wellbore lateral length is below the GBPI-length threshold comprises:

determining a curve for the relationship of GBPI to horizontal wellbore lateral length; and determining a horizontal wellbore lateral length that corresponds to a point at which a slope of the curve falls below the GBPI-length threshold.

10. The system of claim 7, wherein the horizontal wellbore lateral length at which a ratio of a change of the GBPI for the hydrocarbon well to a corresponding change in the horizontal wellbore lateral length is below the GBPI-length threshold corresponds to a lateral length above which the PI for the hydrocarbon well exhibits a plateau.

11. The system of claim 7, the operations further comprising operating by a well control system, the hydrocarbon well at the production rate, wherein the operating comprises receiving a production rate from a well flowrate sensor.

12. The system of claim 7, the operations further comprising:

identifying second candidate well parameters for a second hydrocarbon well, the second candidate well parameters comprising:

a second location for the second hydrocarbon well;

a second well production rate for the second hydrocarbon well; and second candidate horizontal wellbore lateral lengths for a horizontal portion of a wellbore of the second hydrocarbon well;

conducting, for each candidate horizontal wellbore lateral length of the second candidate horizontal wellbore lateral lengths, a simulation of a hydrocarbon well located at the second location and having a wellbore having a horizontal wellbore portion of a lateral length that corresponds to the candidate horizontal wellbore lateral length and operating at the second well production rate, the simulation comprising:

determining a gas breakthrough into the wellbore of the simulated hydrocarbon well;

determining a gas breakthrough time that corresponds to the time of the gas breakthrough into the wellbore of the simulated hydrocarbon well; and determining a GBPI for the simulated hydrocarbon well that corresponds to a productivity index (PI) of the simulated hydrocarbon well at the gas breakthrough time;

determining, based on the GBPIs for the second candidate horizontal wellbore lateral lengths and the second well production rate, a relationship of GBPI to horizontal wellbore lateral length;

determining, based on the relationship of GBPI to horizontal wellbore lateral length, a second optimized horizontal wellbore lateral length for the second production rate that corresponds to a horizontal wellbore lateral length at which a ratio of a change of the GBPI for the simulated hydrocarbon well to a corresponding change in the horizontal wellbore lateral length is below a GBPI-length threshold; and drilling, at the second location, the second hydrocarbon well having a horizontal wellbore lateral length that corresponds to the second optimized horizontal wellbore lateral length.

13. A non-transitory computer readable storage medium comprising program instructions stored thereon that are executable by a processor to perform the following operations for developing a hydrocarbon well:

identifying candidate well parameters for a hydrocarbon well, the candidate well parameters comprising:

a location for the hydrocarbon well;

a well production rate for the hydrocarbon well; and candidate horizontal wellbore lateral lengths for a horizontal portion of a wellbore of the hydrocarbon well;

conducting, for each candidate horizontal wellbore lateral length of the candidate horizontal wellbore lateral lengths, a simulation of a hydrocarbon well located at the location and having a wellbore having a horizontal wellbore portion of a lateral length that corresponds to the candidate horizontal wellbore lateral length and operating at the well production rate, the simulation comprising:

determining a gas breakthrough into the wellbore of the simulated hydrocarbon well;

determining a gas breakthrough time that corresponds to the time of the gas breakthrough into the wellbore of the simulated hydrocarbon well; and determining a gas breakthrough productivity index (GBPI) for the simulated hydrocarbon well that corresponds to a productivity index (PI) of the simulated hydrocarbon well at the gas breakthrough time;

determining, based on the gas breakthrough productivity indexes (GBPIs) for the candidate horizontal wellbore lateral lengths and the well production rate, a relationship of GBPI to horizontal wellbore lateral length; and determining, based on the relationship of GBPI to horizontal wellbore lateral length, an optimized horizontal wellbore lateral length for the production rate that corresponds to a horizontal wellbore lateral length at which a ratio of a change of the GBPI for the simulated hydrocarbon well to a corresponding change in the horizontal wellbore lateral length is below a GBPI-length threshold; and drilling, using a drill bit boring through a formation at the location, the hydrocarbon well having a wellbore having a horizontal wellbore portion having a lateral length that corresponds to the optimized horizontal wellbore lateral length.

14. The medium of claim 13, wherein the candidate well parameters comprises a second well production rate for the hydrocarbon well, and wherein the operations further comprise:

conducting, for each candidate horizontal wellbore lateral length of the candidate horizontal wellbore lateral lengths, a simulation of a hydrocarbon well located at the location and having a wellbore having a horizontal wellbore portion of a lateral length that corresponds to the candidate horizontal wellbore lateral length and operating at the second well production rate, the simulation comprising:

determining a gas breakthrough into the wellbore of the simulated hydrocarbon well;

determining a gas breakthrough time that corresponds to the time of the gas breakthrough into the wellbore of the simulated hydrocarbon well; and determining a GBPI for the simulated hydrocarbon well that corresponds to a PI of the simulated hydrocarbon well at the gas breakthrough time;

determining, based on the gas breakthrough productivity indexes (GBPIs) for the candidate horizontal wellbore lateral lengths and the second production rate, a second relationship of GBPI to horizontal wellbore lateral length; and determining, based on the second relationship of GBPI to horizontal wellbore lateral length, an optimized horizontal wellbore lateral length for the second production rate that corresponds to a horizontal wellbore lateral length at which a ratio of a change of the GBPI for the hydrocarbon well to a corresponding change in the horizontal wellbore lateral length is below the GBPI-length threshold.

15. The medium of claim 13, wherein determining the optimized horizontal wellbore lateral length for the production rate that corresponds to a horizontal wellbore lateral length at which a ratio of a change of the GBPI for the hydrocarbon well to a corresponding change in the horizontal wellbore lateral length is below the GBPI-length threshold comprises:

determining a curve for the relationship of GBPI to horizontal wellbore lateral length; and determining a horizontal wellbore lateral length that corresponds to a point at which a slope of the curve falls below the GBPI-length threshold.

16. The medium of claim 13, wherein the horizontal wellbore lateral length at which a ratio of a change of the GBPI for the hydrocarbon well to a corresponding change in the horizontal wellbore lateral length is below the GBPI-length threshold corresponds to a lateral length above which the PI for the hydrocarbon well exhibits a plateau.

17. The medium of claim 13, the operations further comprising operating, by a well control system, the hydrocarbon well at the production rate, wherein the operating comprises receiving a production rate from a well flowrate sensor.

18. The medium of claim 13, the operations further comprising:

identifying second candidate well parameters for a second hydrocarbon well, the second candidate well parameters comprising:

a second location for the second hydrocarbon well;

a second well production rate for the second hydrocarbon well; and second candidate horizontal wellbore lateral lengths for a horizontal portion of a wellbore of the second hydrocarbon well;

conducting, for each candidate horizontal wellbore lateral length of the second candidate horizontal wellbore lateral lengths, a simulation of a hydrocarbon well located at the second location and having a wellbore having a horizontal wellbore portion of a lateral length that corresponds to the candidate horizontal wellbore lateral length and operating at the second well production rate, the simulation comprising:

determining a gas breakthrough into the wellbore of the simulated hydrocarbon well;

determining a gas breakthrough time that corresponds to the time of the gas breakthrough into the wellbore of the simulated hydrocarbon well; and determining a GBPI for the simulated hydrocarbon well that corresponds to a productivity index (PI) of the simulated hydrocarbon well at the gas breakthrough time;

determining, based on the GBPIs for the second candidate horizontal wellbore lateral lengths and the second well production rate, a relationship of GBPI to horizontal wellbore lateral length;

determining, based on the relationship of GBPI to horizontal wellbore lateral length, a second optimized horizontal wellbore lateral length for the second production rate that corresponds to a horizontal wellbore lateral length at which a ratio of a change of the GBPI for the simulated hydrocarbon well to a corresponding change in the horizontal wellbore lateral length is below a GBPI-length threshold; and drilling, at the second location, the second hydrocarbon well having a horizontal wellbore lateral length that corresponds to the second optimized horizontal wellbore lateral length.

* * * * *